United States Patent [19]

Akiyama et al.

[11] 4,248,527

[45] Feb. 3, 1981

[54] APPARATUS FOR CONTROLLING TONER CONCENTRATION IN ELECTROPHOTOGRAPHIC COPYING MACHINES

[75] Inventors: Mistuo Akiyama; Hiroshi Kuru, both of Hachioji, Japan

[73] Assignee: Konishiroku Photo Industry Co., Ltd., Tokyo, Japan

[21] Appl. No.: 1,059

[22] Filed: Jan. 5, 1979

[30] Foreign Application Priority Data

Jan. 17, 1978 [JP] Japan ..... 53/2760

[51] Int. Cl.[3] ..... G03G 15/00

[52] U.S. Cl. ..... 355/14 R; 118/665; 118/668; 355/14 D

[58] Field of Search ..... 355/3 R, 3 DD, 14 R, 355/14 D, 14 E; 118/665, 668, 691, 693

[56] References Cited

U.S. PATENT DOCUMENTS

| | | | |
|---|---|---|---|
| 3,604,796 | 9/1971 | Ogawa | 355/14 R |
| 3,815,988 | 6/1974 | McVeigh et al. | 118/691 X |
| 3,872,825 | 3/1975 | Davidson | 118/691 |
| 4,025,184 | 5/1977 | Mochizuki | 355/14 D X |
| 4,142,792 | 3/1979 | Satomi et al. | 118/668 X |

*Primary Examiner*—Fred L. Braun

*Attorney, Agent, or Firm*—Bierman & Bierman

[57] ABSTRACT

An apparatus for controlling the toner concentration in electrophotographic copying machines produces a toner concentration signal in response to the density of a reference patch image formed on a moving electrophotosensitive medium. The patch image density is detected at a time corresponding to a predetermined extent of movement of the electrophotosensitive medium following receipt of a signal indicating scanning of the original to be copied.

1 Claim, 2 Drawing Figures

APPARATUS FOR CONTROLLING TONER CONCENTRATION IN ELECTROPHOTOGRAPHIC COPYING MACHINES

The present invention relates to an electrophotographic copying machine in general and especially to an apparatus for controlling the concentration of developing toners by detecting the density of a reference toner image which can be obtained by developing an electrostatic image of a patch (a standard mark) having a predetermined uniform density on a photosensitive medium which electrostatic image is formed on the photosensitive medium through an optical system by light exposure on the patch.

Figure 1:
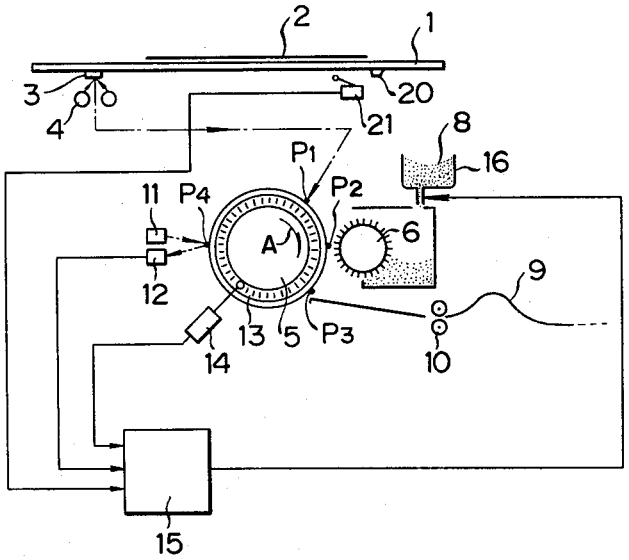
Figure 2:
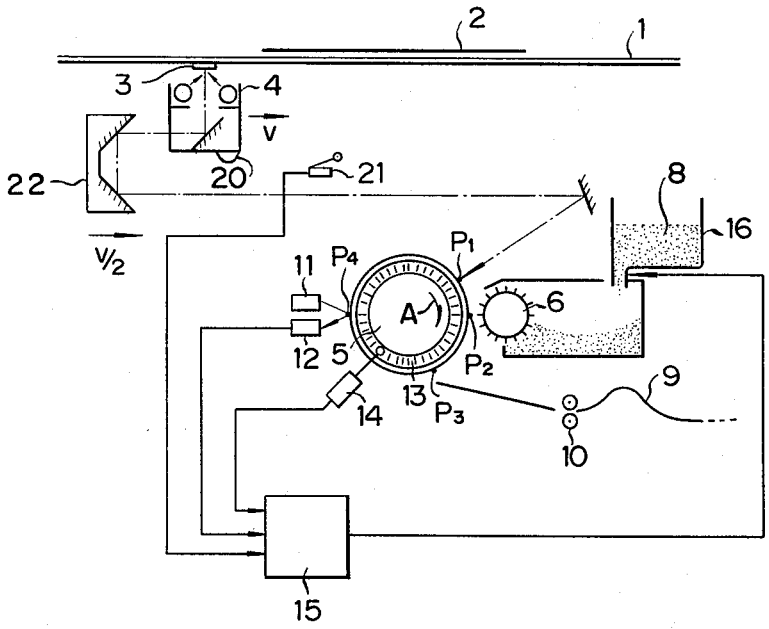

A toner concentration control method of this kind will be described by referring to the drawing. FIGS. 1 and 2 are schematic views showing general arrangements of electrophotographic copying machines incorporating a toner concentration control apparatus. Reference numeral 1 denotes an original carrier plate on which an original to be copied is disposed. Patch 3 having a predetermined uniform density is provided on the lower surface of the original carrier plate 1 in front of or in succession to a region in which the original to be copied is positioned. When the original carrier plate 1 is moved upon copying operation, the patch 3 is exposed to irradiation of light from a light source 4 so that the reflected light image of the patch 3 is projected onto a photo-sensitive layer formed on a drum 5 which has been previously uniformly electrically charged, whereby an electrostatic latent image of the patch 3 is formed on the surface layer of the drum 5. Upon initiation of the copying operation, the drum 5 is rotated in the direction indicated by an arrow A in a proper timing relation with the movement of the original carrier plate 1. The electrostatic latent images of the original 2 and the patch 3 are formed at a location P1 and developed at a location P2 by a brushing contact of a magnetic brush roller 6 (developing electrode) adhered with a mixture of toner particles and an iron powder. A controlled quantity of toner material 8 is supplied to the magnetic brush roller 6 from a toner supply apparatus 16. On the other hand, a recording sheet 9 is supplied from a sheet supply source through a feeding and transporting roller apparatus 10 which is driven in a controlled timing relation to the rotation of the drum 5 in such a manner that the recording sheet is appropriately superposed, at a location P3, on the toner image of the original 2, which image is obtained by exposure of the original onto the photosensitive layer and thereafter by the development as explained before. Subsequently, transfer of the toner image to the recording sheet and fixation thereof are effected.

On the other hand, the toner image of the patch 3 on the drum surface is exposed to light irradiation from a light emitter element 11 at a location P4, and the reflected light beam from the toner image of the patch is detected by a photo-sensor 12, the output signal from which is utilized as a control signal for controlling the toner supply to maintain a desired toner concentration through a control device described hereinafter.

Mounted rotatably with the drum 5 is a disc 13 having a plurality of holes formed in a circular array in the peripheral edge portion thereof in a uniform distribution. In combination with the perforated disc 13, an angle detector 14 which may be composed of a photo-sensor is disposed to receive a light beam passed through the holes formed in the disc 13. Thus, the output signal from the angle detector 14 will be a pulse signal having a pulse repetition frequency which represents proportionally the rotation angle of the drum 5.

The control circuit device 15, which may be constituted by a micro-computer, receives the output pulse signal from the angle detector 14 in response to the command to initiate the copying operation and controls the reciprocating movement of the original carrier plate 1 by actuating a clutch interposed between the original carrier plate 1 and the driving source therefor as well as the driving of the drum 5, magnetic brush roller 6 and the sheet feeding roller apparatus 10 in proper timing and sequence. Further, when the toner image of the patch 3 formed at the location P1 and developed at P2 has been rotated to the position P4, the control circuit 15 supplies the output signal from the photo-sensor 12 or a corresponding digital signal to the toner supply device 16 as the toner concentration control signal under the control of the timing signal derived from the output pulse signal of the angle detector 14.

In this manner, it is possible to control the concentration of toner for developing the electrostatic latent image of an original to the copied by controlling the toner supply to the developing electrode or magnetic brush roller 6 on the basis of the detected density of the reference toner image of the patch 3. In this connection, it will be noted that erroneous control will result, when the output signal from the photo-sensor 12 produced before or after the passing of the toner image of the patch at the location P4 is used as the control quantity for the toner concentration control. It is thus required that the detection of the density of the reference toner image of the patch be effected precisely at the position P4.

In conjunction with the detection of the toner image of the patch, the detection of the rotation angle of the drum 5 can be carried out with an enhanced accuracy by increasing the number of the holes formed in the perforated disc 13 and/or improving the dimensional precision thereof. However, since the actual position of the patch relative to the drum is likely to vary due to deviations in the start or stop position of the original carrier plate 1 as caused by slip in the clutch connecting the movement of the plate 1 and the movement of the drum, there may arise a difference between the target position for detecting the patch image in toner as determined by the pulse signal supplied from the angle detector 14 to the control circuit 15 and the actual position at which the patch image is really detected. In this connection, it should be recalled that the supply of the toner concentration control signal to the toner supply apparatus 16 is effected under the control of the timing signal derived from the pulse signal output from the angle detector 14. Consequently, mismatch or noncoincidence between the target and actual positions for detecting the patch image will bring about an undesirable situation such that the toner concentration at the developing electrode may not be controlled on the basis of the reference density of the patch image. Such disadvantage may be eliminated by enlarging the dimension of the patch image. However, this solution will then be accompanied by other drawbacks. For example, an original carrier plate of a larger size must be used to accommodate the disposition of the enlarged patch. The toner consumption will be correspondingly increased for developing the latent patch image of a large size. In addition, problems will be involved in connection with the cleaning of the drum.

Accordingly, an object of the invention is to provide a toner density control apparatus which is capable of detecting the reference patch image on the photo-sensitive drum with a high accuracy even when a small size of patch is used.

IN THE DRAWINGS

FIG. 1 is a schematic representation of an electrophotographic copying apparatus in accordance with the present invention; and FIG. 2 is a schematic representation of another embodiment in accordance with the present invention.

According to an embodiment of the invention referring to FIG. 1, a cam member 20 is provided at the lower surface of the original carrier plate 1 at a preselected position on the one hand, and on the other hand a micro-switch 21 is provided on a body of the copying apparatus at a position lying in the moving path of the cam member 20 so as to be actuated by the latter when the original carrier plate 1 is moved. The output signal as produced from micro-switch 21 due to the actuation by the cam member 20 is utilized as the starting signal with reference to which the rotation angle of the drum 5 to the location P4 is determined on the basis of the output pulse signal from the angle sensor 14 in the control circuit 15.

With the arrangement of the cam member 20 in combination with the micro-switch 21 as described above, the time span between the actuation of the micro-switch 21 and the passing of the reference patch image on the drum 5 at the location P4 where the patch image is detected by the combination of the light emitting element 11 and the photo-cell 12 can remain constantly invariable in spite of possible deviations in the starting (or stopping) position of the original carrier plate 1 described hereinbefore. In other words, according to the teaching of the invention, the target position for detecting the density of the reference toner image will coincide with the actual position at which the reference toner image is really detected, as a result of which the control signal reflecting the density of the reference toner image is supplied to the toner supplying apparatus 16 for controlling the concentration of the toner in the proper timing relation independently from any possible variation in the starting or stopping position of the original carrier plate 1.

Referring to FIG. 2, this indicates another embodiment of the invention. As shown in the drawing, the cam member 20 is located on the movable light source 4, not on the original carrier plate 1. The micro-switch 21 operable by the cam member is positioned along a path in which the light source is moved. 22 Is a movable mirror to reflect a light from an original to the electrophotosensitive medium. Output from the micro switch is used as explained in FIG. 1. To be noted is that the speed of the movable mirror is half that of the movable light source.

Although a combination of the cam member and the micro-switch is used for producing the start or reference signal for determining the angular distance for the patch image to reach the detection place P4 in the case of the illustrated embodiments, it is apparent that other combinations of optical and/or electrical detecting elements may be employed. Further, the detecting means for the reference toner image of the patch may be additionally used to produce a timing signal for initiating the driving of the sheet feeding or transporting roller apparatus.

As will be appreciated from the foregoing description, adverse influences of deviations in the starting or stopping position of the original carrier plate to the detection of the patch image on the drum can be positively excluded, whereby the accuracy required for detecting the position of the patch image on the drum can be significantly enhanced. Additionally, a patch of a small size may be used and thus the disadvantages described hereinbefore in conjunction with the use of a patch of a relatively large size can be eliminated.

What is claimed is:

1. In an improved apparatus for controlling the toner concentration in an electrophotographic copying machine having an original carrier plate for supporting an original to be copied at a predetermined location thereon, an electrophotosensitive medium adapted for movement during operation of the copying machine, an optical system positioned between the original carrier plate and the electrophotosensitive medium, means for relatively moving the original carrier plate and the optical system with respect to each other along a path to scan the original and to optically transmit an image of the same onto the medium during movement along said path so as to form an electrostatic image of the original on the medium, a developing device for changing the electrostatic image to a visible toner image and including means for controlling the toner concentration of a developed toner image, and means for measuring the extent of operative movement of the electrophotosensitive medium; said apparatus including a patch of a predetermined uniform density carried on the original carrier plate at a location remote from the predetermined location for supporting the original to be copied, said patch location being such that during said relative movement of the carrier plate and optical system the image of the patch is scanned and transmitted by the optical system onto the electrophotosensitive medium to form thereon an electrostatic image of the patch, and a detector for measuring the density of the developed toner image of the patch and for generating an output signal variable in accordance with image density for enabling control of the toner concentration of the toner image of the original; the improvement comprising;

switch means on the copying machine actuatable at a predetermined position of the original carrier plate along said path of relative movement with respect to the optical system adapted when actuated to produce a first control signal, and control means responsive to the movement measuring means and the patch image density detector and said switch means for producing a second control signal at a time corresponding to a predetermined extent of movement of the electrophotosensitive medium following receipt of said first control signal, said second control signal operating the toner concentration control means in accordance with the output of the detector as the moving medium carries the patch toner image to a measurement-enabling position with respect to the detector.

* * * * *